United States Patent [19]

Weingardt

[11] Patent Number: 5,042,818

[45] Date of Patent: Aug. 27, 1991

[54] MULTI-DECK POKER GAME

[76] Inventor: Gary Weingardt, 3671 Tioga Way, Las Vegas, Nev. 89109

[21] Appl. No.: 444,634

[22] Filed: Dec. 1, 1989

[51] Int. Cl.[5] ..... A63F 1/00

[52] U.S. Cl. ..... 273/292; 273/85 CP; 273/274; 273/85 G

[58] Field of Search ..... 273/85 CP, 85 G, 237, 273/274, 292

[56] References Cited

U.S. PATENT DOCUMENTS 4,743,022 5/1988 Wood ..... 273/85 CP
4,861,041 8/1989 Jones et al. ..... 273/292

FOREIGN PATENT DOCUMENTS 2169736 7/1986 United Kingdom ..... 273/85 CP
2169737 7/1986 United Kingdom ..... 273/85 CP

*Primary Examiner*—Edward M. Coven
*Assistant Examiner*—Raleigh W. Chiu
*Attorney, Agent, or Firm*—Fulwider Patton Lee & Utecht

[57] ABSTRACT

A multi-deck poker game creating the possibility of poker hands unavailable in conventional poker, without the use of wild cards. A first hand of five cards is dealt from a first deck of playing cards. The player may select an additional card or cards to be dealt from at least one additional deck of cards. The player may discard cards, with replacement cards coming from the original decks from which the discards were dealt. Thus, a hand of six or more cards may be created that has the possibility of producing poker hands unavailable from a single deck of cards. A progressive jackpot may be provided for low probability hands such as a seven card royal flush. The game may be implemented in a video poker game of the type used in gaming establishments.

32 Claims, 7 Drawing Sheets

SUPER CARD VIDEO POKER
PAYOUT SCHEDULE

| | 1ST COIN WINNERS | 2ND COIN WINNERS | 3RD COIN WINNERS | 4TH COIN WINNERS | 5TH COIN WINNERS | 1ST SUPER CARD WINNERS | 2ND SUPER CARD WINNERS |
|---|---|---|---|---|---|---|---|
| SUPER ROYAL FLUSH | --- | --- | --- | --- | --- | 7000 | SUPER JACKPOT |
| ROYAL FLUSH | 250 | 500 | 750 | 1000 | 4000 | --- | --- |
| SUP. STRAIGHT FLUSH | --- | --- | --- | --- | --- | 300 | 600 |
| STRAIGHT FLUSH | 50 | 100 | 150 | 200 | 250 | --- | --- |
| SUP. 5/6 OF A KIND | --- | --- | --- | --- | --- | 150 | 300 |
| 4 OF A KIND | 25 | 50 | 75 | 100 | 125 | --- | --- |
| FULL HOUSE | 8 | 16 | 24 | 32 | 40 | --- | --- |
| SUPER FLUSH | --- | --- | --- | --- | --- | 30 | 60 |
| FLUSH | 5 | 10 | 15 | 20 | 25 | --- | --- |
| SUPER STRAIGHT | --- | --- | --- | --- | --- | 24 | 48 |
| STRAIGHT | 4 | 8 | 12 | 16 | 20 | --- | --- |
| THREE OF A KIND | 3 | 6 | 9 | 12 | 15 | --- | --- |
| TWO PAIR | 2 | 4 | 6 | 8 | 10 | --- | --- |
| JACKS OR BETTER | 1 | 2 | 3 | 4 | 5 | --- | --- |

SUPER CARD OPTIONAL BET AFTER THE DEAL

FIG. 6

SUPER CARD INTERCHANGEABLE VIDEO POKER
PAYOUT SCHEDULE

| | 1ST COIN WINNERS | 2ND COIN WINNERS | 3RD COIN WINNERS | 4TH COIN WINNERS | 5TH COIN WINNERS | 1ST SUPER CARD WINNERS | 2ND SUPER CARD WINNERS |
|---|---|---|---|---|---|---|---|
| ROYAL FLUSH | 25 | 50 | 75 | 100 | 125 | 7000 | SUPER JACKPOT |
| STRAIGHT FLUSH | 9 | 18 | 27 | 36 | 45 | 300 | 600 |
| 4-5-6 OF A KIND | 5 | 10 | 15 | 20 | 25 | 150 | 300 |
| FULL HOUSE | 3 | 6 | 9 | 12 | 15 | --- | 96 |
| FLUSH | 2 | 4 | 6 | 8 | 10 | 30 | 60 |
| STRAIGHT | 2 | 4 | 6 | 8 | 10 | 24 | 48 |
| THREE OF A KIND | 1 | 2 | 3 | 4 | 5 | --- | --- |

THIS GAME IS PLAYED BY DEPOSITING SIXTH COIN BEFORE THE DEAL

FIG. 7

SUPER CARD VIDEO POKER
PAYOUT SCHEDULE

| | 1ST COIN WINNERS | 2ND COIN WINNERS | 3RD COIN WINNERS | 4TH COIN WINNERS | 5TH COIN WINNERS | 1ST SUPER CARD WINNERS | 2ND SUPER CARD WINNERS |
|---|---|---|---|---|---|---|---|
| SUPER ROYAL FLUSH | --- | --- | --- | --- | --- | PROGRESSIVE | SUPER PROGRESSIVE JACKPOT |
| ROYAL FLUSH | 250 | 500 | 750 | 1000 | 4000 | --- | --- |
| SUP. STRAIGHT FLUSH | --- | --- | --- | --- | --- | PROGRESSIVE | PROGRESSIVE |
| STRAIGHT FLUSH | 50 | 100 | 150 | 200 | 250 | --- | --- |
| SUP. 5/6 OF A KIND | --- | --- | --- | --- | --- | PROGRESSIVE | PROGRESSIVE |
| 4 OF A KIND | 25 | 50 | 75 | 100 | 125 | --- | --- |
| FULL HOUSE | 8 | 16 | 24 | 32 | 40 | --- | --- |
| SUPER FLUSH | --- | --- | --- | --- | --- | PROGRESSIVE | PROGRESSIVE |
| FLUSH | 5 | 10 | 15 | 20 | 25 | --- | --- |
| SUPER STRAIGHT | --- | --- | --- | --- | --- | PROGRESSIVE | PROGRESSIVE |
| STRAIGHT | 4 | 8 | 12 | 16 | 20 | --- | --- |
| THREE OF A KIND | 3 | 6 | 9 | 12 | 15 | 18 | 18 |
| TWO PAIR | 2 | 4 | 6 | 8 | 10 | 12 | 12 |
| JACKS OR BETTER | 1 | 2 | 3 | 4 | 5 | 6 | 6 |

SUPER CARD OPTIONAL BET AFTER THE DEAL

FIG. 8

SUPER CARD INTERCHANGEABLE VIDEO POKER
PAYOUT SCHEDULE

| | 1ST COIN WINNERS | 2ND COIN WINNERS | 3RD COIN WINNERS | 4TH COIN WINNERS | 5TH COIN WINNERS | 1ST SUPER CARD WINNERS | 2ND SUPER CARD WINNERS |
|---|---|---|---|---|---|---|---|
| ROYAL FLUSH | 25 | 50 | 75 | 100 | 125 | PROGRESSIVE | SUPER PROGRESSIVE JACKPOT |
| STRAIGHT FLUSH | 9 | 18 | 27 | 36 | 45 | PROGRESSIVE | PROGRESSIVE |
| 4-5-6 OF A KIND | 5 | 10 | 15 | 20 | 25 | PROGRESSIVE | PROGRESSIVE |
| FULL HOUSE | 3 | 6 | 9 | 12 | 15 | --- | PROGRESSIVE |
| FLUSH | 2 | 4 | 6 | 8 | 10 | PROGRESSIVE | PROGRESSIVE |
| STRAIGHT | 2 | 4 | 6 | 8 | 10 | PROGRESSIVE | PROGRESSIVE |
| THREE OF A KIND | 1 | 2 | 3 | 4 | 5 | 6 | --- |

THIS GAME IS PLAYED BY DEPOSITING SIXTH COIN BEFORE THE DEAL

FIG. 9

MULTI-DECK POKER GAME

FIELD OF THE INVENTION

This invention relates to a draw poker game, and more particularly to a draw poker game using more than one deck of cards.

BACKGROUND OF THE INVENTION

Description of the Related Art

Conventional draw poker is well known and comprises a player being dealt a five card hand. If the player is dissatisfied with one or more of the cards in his hand, he can discard those and draw new cards. The object is to make the highest hand according to the generally accepted poker hand ranking. The priority of winning hands is determined by the conventional rules of poker. As is known to those skilled in the art, five card poker hands are ranked according to the following order with a Royal Flush being the highest winning hand:

1. Royal Flush
2. Straight Flush
3 Four of a Kind
4. Full House
5. Flush
6. Straight
7. Three of a Kind
8. Two Pair
9. One Pair
10. High Card in Hand Normally, a plurality of players are involved in each deal and the player with the highest poker hand wins. Players may wager tokens, chips or other items having monetary value on the outcome of the hand in jurisdictions which allow wagering on such a game of skill and chance.

Beginning in approximately the late 1970's, electronic poker devices incorporating a video display began to appear in legalized casinos. These devices are commonly referred to as "video poker machines". This electronic version of draw poker is a one player game in which the player is completing against the predetermined odds of the game. The player inserts one to five gaming tokens into a coin acceptor of the video poker machine and then the player presses the "Deal" button to begin the game. The player is dealt a five card hand from a single deck of cards which appear on the video display terminal of the machine. The player then decides which cards to hold and which to discard. The player receives replacement cards for the discarded cards and the resulting hand is compared to conventional poker hand rankings to determine if the player has won. The player receives payment determined by the amount of the player's bet based on the type of poker hand that the player has. A typical payoff schedule for video poker is as follows:

| | Payout Based on Number of Tokens Wagered | | | | |
|---|---|---|---|---|---|
| Type of Hand | One | Two | Three | Four | Five |
| Royal Flush | 250 | 500 | 750 | 1000 | 4000 |
| Straight Flush | 50 | 100 | 150 | 200 | 250 |
| Four of a Kind | 25 | 50 | 75 | 100 | 125 |
| Full House | 8 | 16 | 24 | 32 | 40 |
| Flush | 5 | 10 | 15 | 20 | 25 |
| Straight | 4 | 8 | 12 | 16 | 20 |

-continued

| | Payout Based on Number of Tokens Wagered | | | | |
|---|---|---|---|---|---|
| Type of Hand | One | Two | Three | Four | Five |
| Three of a Kind | 3 | 6 | 9 | 12 | 15 |
| Two Pairs | 2 | 4 | 6 | 8 | 10 |
| Pair of Jacks (or better) | 1 | 2 | 3 | 4 | 5 |

If the player's hand has a poker ranking less than a pair of jacks, the player loses his wager.

Video poker machines have become quite popular, both in gaming versions and in amusement versions (an amusement version being one in which no coins or other monetary award is received by the player; rather, points are simply accumulated and the player participates for amusement only).

Due to the mathematical odds inherent in five-card draw poker, there is a limit on the size of the payoff that can be made for any particular poker hand. In the gaming version, the limit is usually 250-for-1 on a Royal Flush for each token bet to ensure a fair return for the gaming establishment. As shown in the above schedule, many gaming establishments provide an increased payout of 4,000 tokens for a Royal Flush if five tokens have been bet. Also, because a single deck of cards is used, players cannot achieve hands such as natural five or six of a kind without the use of wild cards such as deuces or jokers.

Gaming establishments have also been known to provide a progressive jackpot component in connection with electronic or mechanical gaming devices, such as video poker machines. Typically a plurality or "bank" of machines are electronically interconnected to a common progressive jackpot meter. As gaming tokens are fed into each machine, the amount shown on the jackpot meter progresses incrementally until some lucky player achieves a Royal Flush. Normally, only if the player is playing the maximum number of tokens, say five, is he eligible to win the progressive jackpot. (The progressive jackpot amount replaces the typical 4,000 token payout that the player would receive for a Royal Flush). A percentage of the fifth token is allocated to fund the progressive meter amount.

While such video poker games have achieved a higher degree of success, they have not provided the opportunity for extremely high jackpots of the type associated with lotteries and other progressive games of chance. Accordingly, it would be desirable if the video poker game concept could be combined with a progressive jackpot to enhance the lure of the game to the wagerer, thus resulting in increased wagering traffic.

The present invention provides a draw poker game that permits very high payoffs on particular poker hands, thus providing an increased incentive for the wagerer who is attracted by very large jackpots, even if the chances to win them are relatively low.

SUMMARY OF THE INVENTION

Video poker and other casino poker games are very popular and enjoy substantial success. However, the normal payoffs are governed by the laws of chance and the ranking of the hands according to the rules of poker. The present invention provides a means of substantially increasing the potential payoff according to the desire of the player to participate in the enhanced payoff version and the selection of and wagering on the enhanced form of the game.

The present invention utilizes a draw poker hand that includes, at the option of the player, a sixth or seventh card dealt from an additional deck or decks of cards to allow the player to achieve other types of poker hands, such as six or seven card Straight or Royal Flushes, with the resulting concomitant increase in the amount of the payoff.

The invention utilizes the equivalent of more than one deck of cards in order to allow a player to obtain either a natural five or six of a kind or a natural six or seven card flush or a natural six or seven card straight. Thus, the invention may utilize a progressive jackpot component to allow for very high payoffs if the player achieves a very difficult to obtain hand, such as a seven card Royal Flush.

The larger payoff amounts can be made to the player based upon the increased difficulty in obtaining particular poker hands. Therefore, larger payoffs need not interfere with or depend upon the payoffs made from the original single deck five card hand.

The game of the present invention commences in the same manner as conventional poker. In a first preferred embodiment of the present invention, two extra cards are available to the player, but these extra cards can only be used as the sixth and seventh cards in the player's hand, i.e. when the extra cards are combined with the first five cards, the player will win a particular payout according to the payout schedule for that particular combination of six or seven cards. This version will hereinafter be referred to as the EXTRA CARDS OPTIONAL version. The player may wager one to five tokens to start the game. From a first deck of standard playing cards, five cards are displayed to the player. However, unlike conventional poker, two additional cards from a second standard playing card deck or multiple standard playing decks are also displayed to the player. At this point, the player decides whether he wishes to play a regular five-card draw poker game or whether he wishes to play six- or seven-card draw poker which comprises the original five card hand plus the additional one or two extra cards. If the player elects to play six- or seven-card draw poker, an additional wager is required.

If the player elects to play the regular five-card poker, no additional wager is required and the game proceeds as in conventional poker. The extra cards displayed to the player are simply ignored and form no part of the regular five-card game. After the draw, the player receives payouts from a predetermined payout schedule based on the type of five-card poker hand that the player has.

If the player elects to play six-card poker, the first five cards and the first extra card are treated as if they were combined in the player's six card hand. The player decides which of the six cards he will hold and which he will discard. Any of the cards discarded from the original five card hand are replaced by cards from the original deck. If the player also decides to discard the first extra card (the sixth card), this card is replaced with a card from the second deck. After the draw, the player receives payouts from a predetermined payout schedule based upon the type of poker hand that the player has.

If the player elects to play seven-card poker, the first five cards and the two extra cards are treated as if they were combined in the player's seven card hand. The player decides which of the seven cards he will hold and which he will discard. Any of the cards discarded from the original five card hand may be replaced by cards from the original deck. If the player also decides to discard either or both of the extra cards (the sixth or seventh card), these cards can also be replaced with a card or cards from the second deck. If multiple extra decks are being used, the sixth card could be replaced from the second additional deck and the seventh card could be replaced from the third additional deck. After the draw, the player receives payouts from a predetermined payout schedule based upon the type of poker hand that the player has. A progressive jackpot amount can be paid to the player if the player achieves a seven card Royal Flush (A-K-Q-J-10-9-8 of the same suit). In one version of the game, the additional cards are not interchangeable in the five card hand from the first deck. Payouts are from the sixth and seventh coin column only after the maximum payout is achieved in the respective category of the five card hand from the first deck.

While the game has been described in the context of a card game, those skilled in the art will recognize that the game may also be played as a video game in which the cards are dealt according to the probabilities associated with the number of cards in the decks and previous deals. In such a game, the wager may be in the form of tokens or other input consistent with the apparatus and display system used.

In a second preferred embodiment of the present invention, the player determines how many tokens representing a wager that he will play at the beginning of the hand. This version will be referred to hereinafter as the EXTRA CARDS INTERCHANGEABLE version. If the player wagers between one and five tokens, he plays conventional five card poker. If the player wagers six tokens, he activates the sixth and seventh extra cards. In this version, the player need not wager additional tokens after the deal, since the extra sixth token before the deal activated the sixth and seventh extra cards. The seven cards can be intermixed by the player to achieve the best five-, six- or seven-card hand that the player can achieve.

In another preferred embodiment of the game, the player may elect to always try for a royal flush. This embodiment is referred to hereinafter as the "Power Poker" option. In this embodiment, the player elects at the time of first activity the game that he will win only for a royal flush. The cards are dealt as before, but the payoff schedule is adjusted to pay a progressive jackpot when a six or seven card royal flush is achieved by the player. Similarly, the game election by the player and payoff could be adjusted to pay off for only the top hands, such as a straight flush and royal flush or other variations with appropriate adjustments in the odds and payoff pot progressions.

From the above, it will be evident to those skilled in the art that the poker game of the present invention provides important advantages over conventional poker games in providing increased enjoyment to those playing the game, particularly to those desiring a higher potential payout from a progressive jackpot. These advantages are particularly advantageous if the game is played with video poker systems. Other aspects and advantages of the invention will become apparent from the following detailed description and accompanying drawings which illustrate, by way of example, the features of the invention.

BRIEF DESCRIPTION OF THE DRAWINGS

FIG. 6 shows a representative payout schedule of the EXTRA CARDS OPTIONAL version of the game of the present invention.

FIG. 7 shows a representative payout schedule of the EXTRA CARDS INTERCHANGEABLE version of the game of the present invention.

FIG. 8 shows a representative payout schedule for the SUPER CARD OPTIONAL BET AFTER THE DEAL OPTION.

FIG. 9 shows a representative payout schedule for depositing a sixth coin as a wager before the deal.

DETAILED DESCRIPTION OF THE PREFERRED EMBODIMENTS

Figure 1:
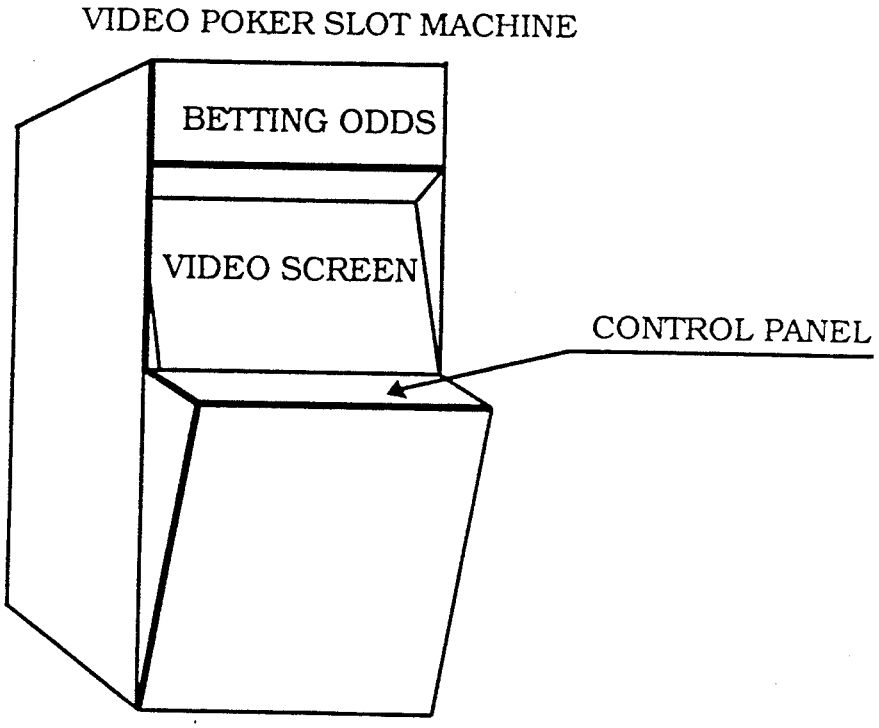
FIG. 1 shows generally a video poker machine of the type which may be used to play the game of the present invention.
Figure 2:
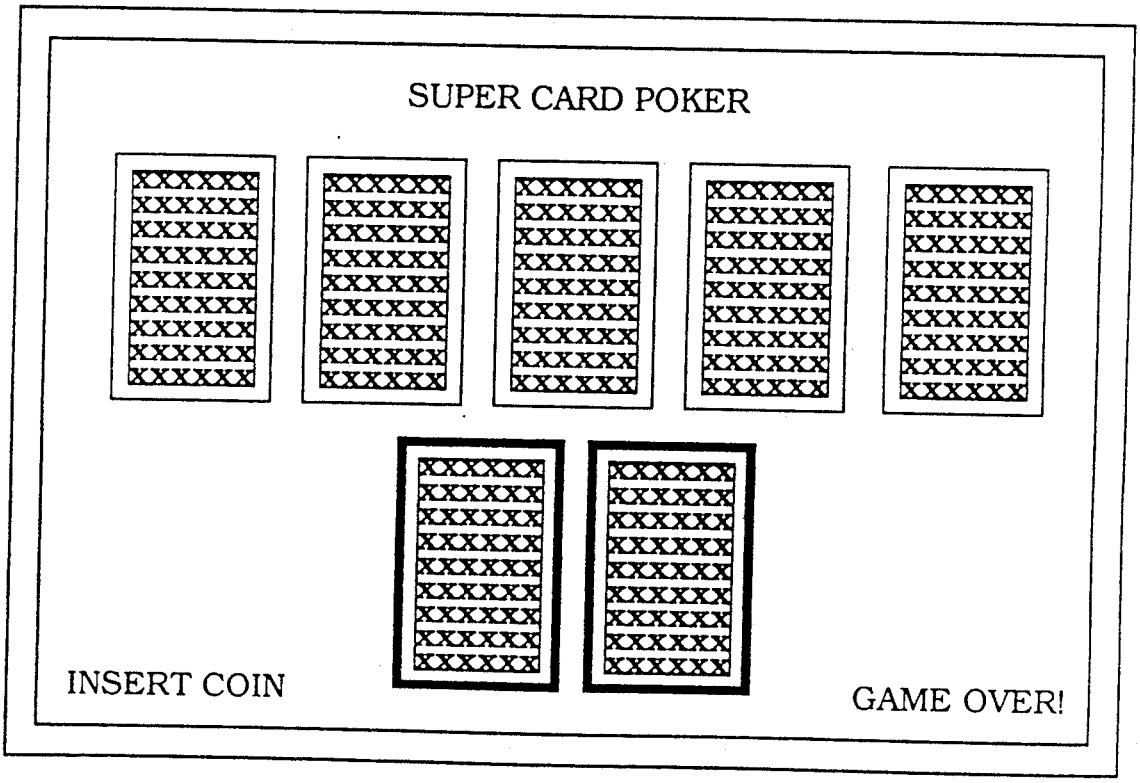
FIG. 2 shows the video terminal screen display that the player will see before the cards are dealt.
Figure 3:
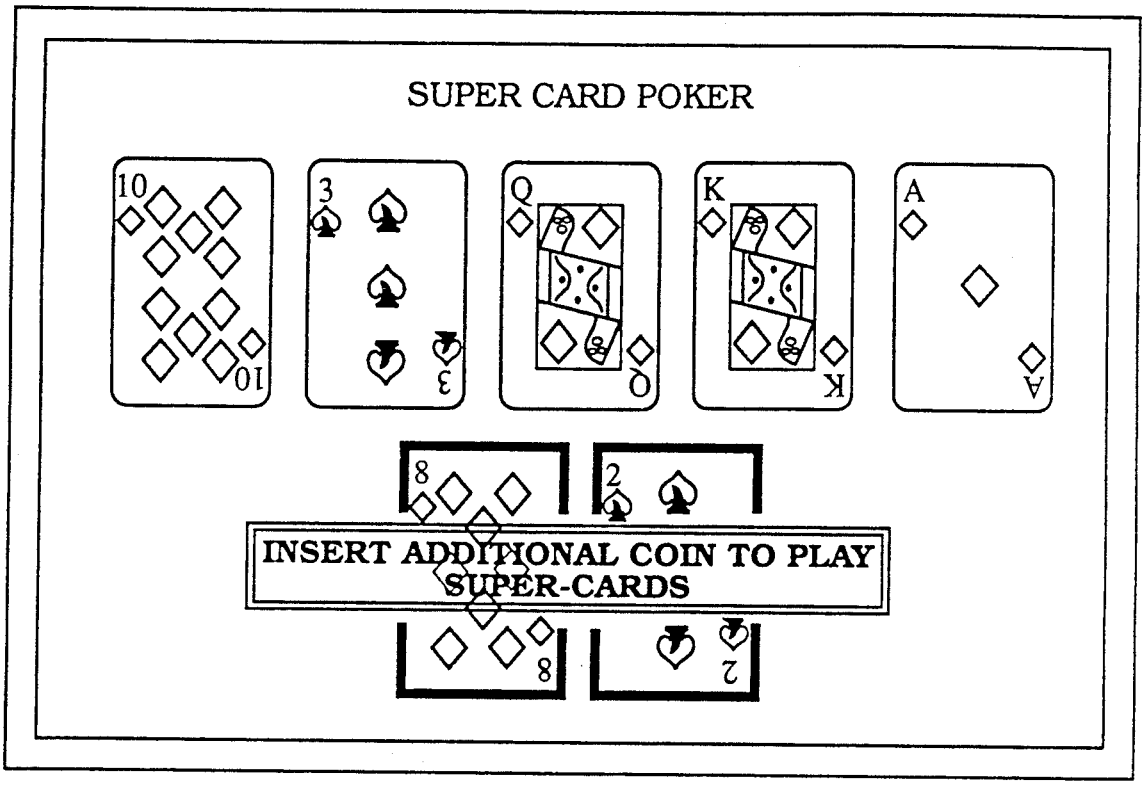
FIG. 3 shows the video terminal screen display that the player will see after the initial cards are dealt, but before the player has decided whether to play a five-card, six-card or seven-card hand.
Figure 4:
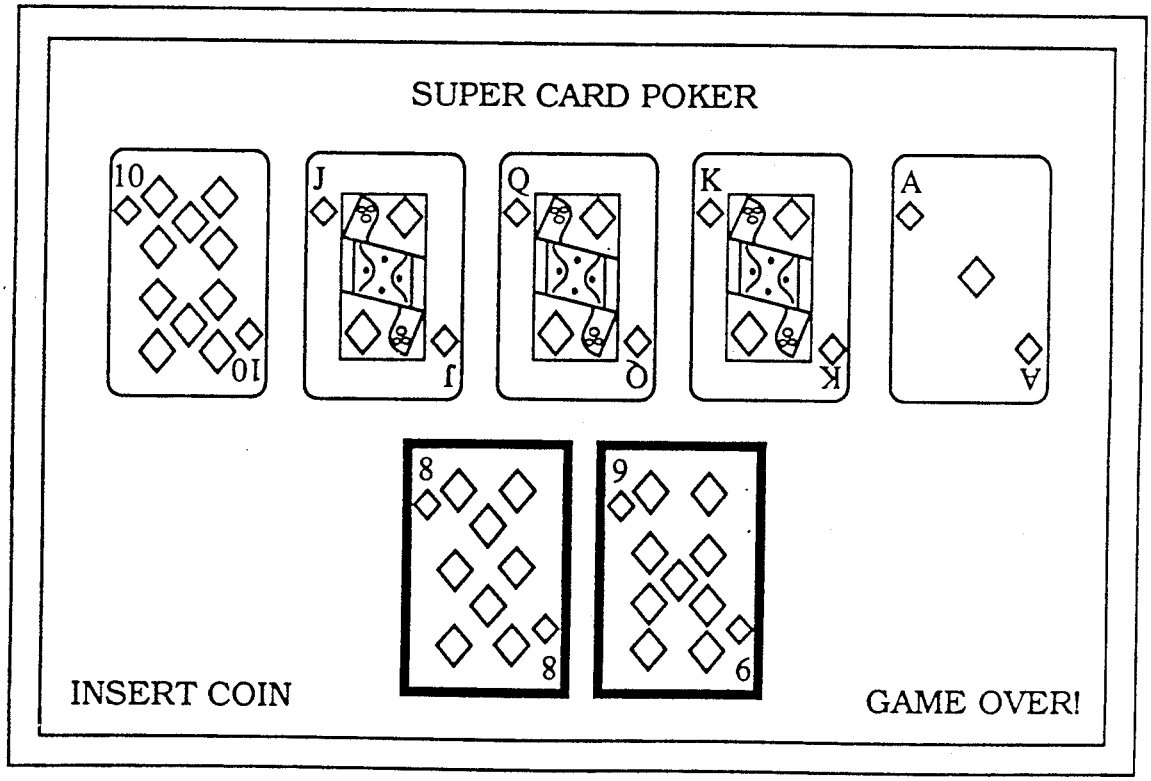
FIG. 4 shows the video terminal screen display that the player will see if the player has elected to play a seven card hand and after the draw has been made.
Figure 5:
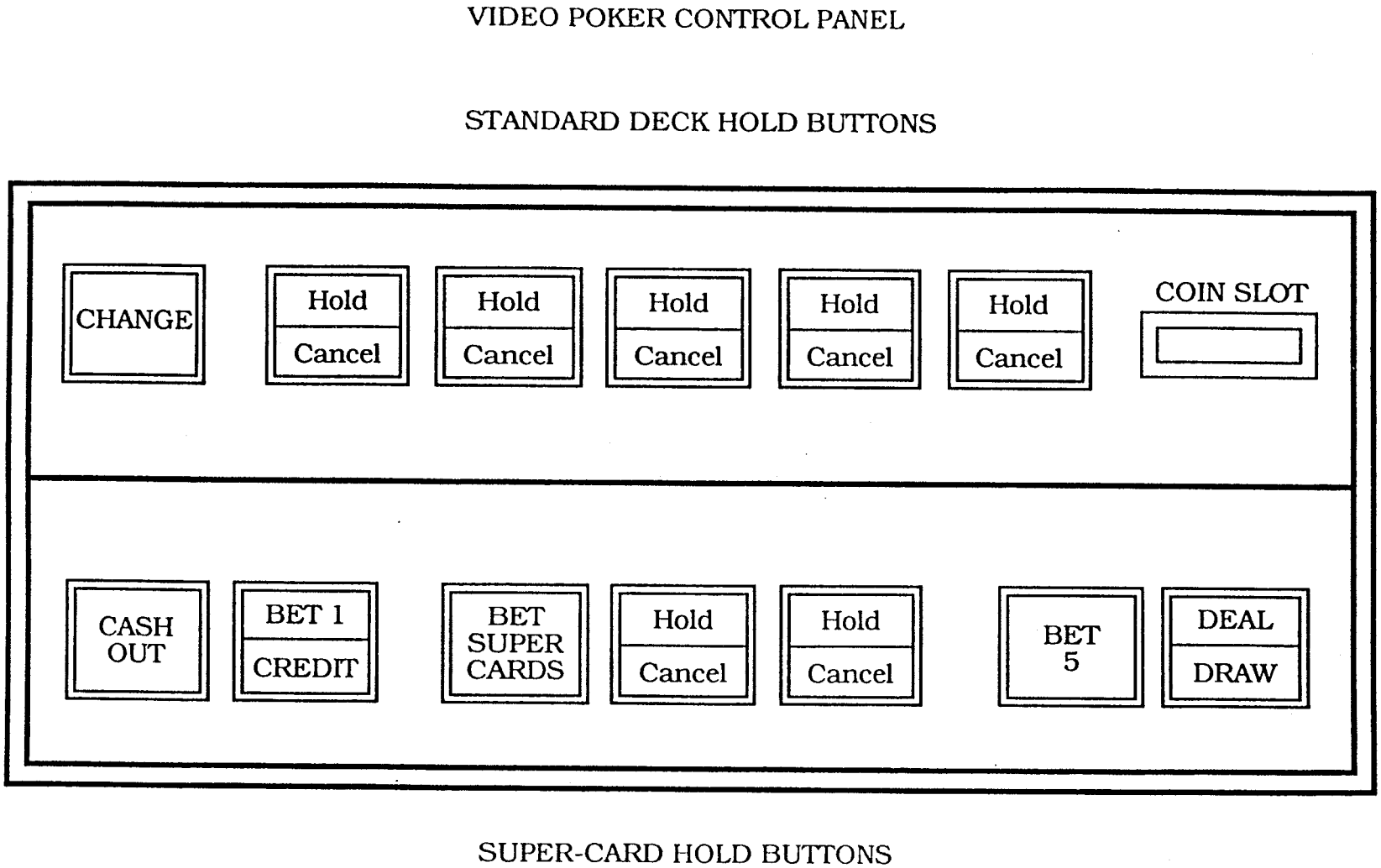
FIG. 5 shows the control panel of the video poker machine used to play the game of the present invention.

VERSION 1. EXTRA CARDS OPTIONAL. The game of this preferred embodiment of the present invention which, for the purposes of illustration, is described in the context of video poker of the type played in casinos, begins in the same way as conventional video poker begins. The player inserts a token or coin to activate the game. In this preferred embodiment of the present invention, if the player inserts less than five tokens, the player can only play the game of five-card draw and the player does not have the option of playing with either the sixth or the seventh extra card. The player must play at least five tokens to have the option of playing with the sixth or seventh extra card.

After the initial tokens (presumably five tokens so that the player has the option of playing the sixth or seventh cards) have been inserted into the coin slot to activate the machine, the player presses the "Deal/-Draw" button and five cards from a first deck of standard playing cards are displayed to the player. Also, two additional cards (the sixth and seventh cards) from a second standard playing card deck are also displayed to the player. Assuming the player has deposited five tokens and is therefore eligible to play the optional sixth and seventh cards, at this point, the player decides whether he wishes to play regular five-card draw poker or whether he wishes to play six- or seven-card draw poker. If the player elects to play six- or seven-card draw poker, an additional wager is required.

In the preferred embodiment, at least one additional token will be required to activate the sixth card and at least one other additional token will be required to activate the seventh card. Alternatively, a single token wager can make the player eligible for both the sixth card and the seventh card. However, in the present preferred embodiment, the player will have wagered five tokens for the five-card hand, a total of six tokens for the six-card hand or a total of seven tokens for the seven-card hand.

If the player elects to play regular five-card draw poker, no additional token is required and the game proceeds as in conventional video poker. The extra cards displayed to the player are simply ignored and form no part of the regular five-card game. The player selects which of the first five cards he wishes to hold by pushing the "Hold/Cancel" button on the control panel that corresponds to the card he wishes to hold. (The "Hold/Cancel" buttons are simply devices that toggle the condition of the card between held and unheld. If the player has pressed the button to hold a particular card and then changes his mind, he simply represses the same button which activates the "Cancel" mode and returns that card to the unheld condition.) Any card not held will be replaced with a new card when the player pushes the "Draw" button. Following the draw step, if the player has a winning hand, he receives the appropriate payout shown in the schedule in FIG. 6 corresponding to the number of tokens or coins between one and five that the player wagered.

If the player wishes to play six-card poker, the player pushes the button marked "Bet Super Cards" and then inserts an additional token or coin into the coin slot. The seventh card is ignored and forms no part of the six-card game. The first five cards and the first extra card are treated as if they were combined in the player's six card hand, but in the EXTRA CARDS OPTIONAL version, the sixth card can only be used in the sixth position of the hand; it cannot be used in lieu of one of the original five cards to form a different five-card hand. The player decides which of the six cards he will hold and which he will discard. Any of the cards discarded from the original five card hand are replaced by cards from the original deck. If the player also decides to discard the first extra card (the sixth card), this card is replaced with a card from the second deck. After the draw, the player receives payouts based on the type of poker hand that the player has according to the payout schedule shown in FIG. 6 corresponding to the "5th" coin column or the "6th" coin column, whichever payout would be the higher amount.

If the player wishes to play seven-card poker, the player pushes the button marked "Bet Super Cards" and then inserts an additional token or coin into the coin slot. In the preferred embodiment, two additional tokens or coins will be required for the player to play the seven-card game. As discussed above, an alternative version of the game of the present invention permits the player to participate in both the six or seven card game by wagering only a single extra token.

If the player elects to play seven-card poker, the first five cards and the two extra cards are treated as if they were combined in the player's seven card hand, but in the EXTRA CARDS OPTIONAL version, the sixth and seventh cards can only be used in the sixth and/or seventh position of the hand; neither card can be used in lieu of one or two of the original five cards to form a different five-card hand. (Just as in conventional poker, the order or sequence of the cards is not critical; thus a hand having 8♥ K♥ J♥ A♥ 10♥ Q♥ 9♥ in this sequence and a hand having A♥ 10♥Q ♥K ♥8♥9♥ J♥ in this sequence are both seven card Royal Flushes. Therefore the order or sequence of the sixth and seventh cards is not critical other than the fact that in the EXTRA CARD OPTIONAL version of the game of the present invention the sixth and seventh cards cannot be substituted into the original five card hand to achieve a particular five card hand.)

The player decides which of the seven cards he will hold and which he will discard. Any of the cards discarded from the original five card hand are replaced by cards from the original deck. If the player also decides to discard either or both of the extra cards (the sixth or seventh card), these cards are replaced with a card or cards from the second deck. If multiple additional decks are being used, the sixth card would be replaced by a card from the second deck and the seventh card would be replaced by a card from the third deck. After the draw, the player receives payouts based on the type of poker hand that the player has according to the payout schedule shown in FIG. 6 corresponding to the "5th" coin column, the "6th" coin column or the "7th" coin column, whichever payout would be the highest amount.

Because in the preferred embodiment the extra sixth and seventh cards come from a separate deck or from two separate decks, it is possible for the player to achieve combinations of cards that could not be obtained using a single deck of standard playing cards. For example, it is possible to achieve Five-of-a-Kind or Six-of-a-Kind. Also because extra cards are involved, it is possible to obtain six or seven card Flushes and six or seven card Straights. Additionally, six or seven card Straight Flushes can be obtained. In fact, the best hand that can be made is a seven card Royal Flush which would be the Ace-King-Queen-Jack-Ten-Nine-Eight of the same suit. (For example, A♥ K♥ Q♥ J♥ 10♥ 9♥ 8 in any order or sequence.) The odds of obtaining a seven card Royal Flush are quite high and allow for a gaming establishment to pay a Super Jackpot on that combination. For example, a jackpot amount of 50,000 tokens, 10,000,000 tokens or even amounts in excess of that could be paid.

In another alternative embodiment of the first version of the present invention, the Super Jackpot for a seven card Royal Flush could be made part of a progressive jackpot. Instead of merely paying a fixed amount for a seven card Royal Flush, a progressive register is used to determine the size of the payoff. A percentage of each token wagered to obtain the sixth and/or seventh card is allocated to an incrementing register electronically associated with the video machine. Each hand that is played that does not result in a paid hand results in the progressive register incrementing to a higher amount using the wagers made by the player to activate the six- and/or seven-card game. Eventually some lucky player will make a seven card Royal Flush and will win the amount displayed on the progressive register. While the particular payouts that can be used are not critical to the use of the game, typical payout schedules that are contemplated to work well in a gaming establishment have been developed. In the EXTRA CARDS OPTIONAL version of the game of the present invention in which the sixth or seventh cards are activated at the option of the player after the initial deal by the player wagering an additional token or tokens, the following payout schedule is preferred:

| EXTRA CARDS OPTIONAL VERSION | | | | | | | |
|---|---|---|---|---|---|---|---|
| | Number of Tokens Wagered | | | | | | |
| Type of Hand | One | Two | Three | Four | Five | Six | Seven |
| Royal Flush (6 or 7 card) | — | — | — | — | — | 7000 | Super Jackpot |
| Royal Flush | 250 | 500 | 750 | 1000 | 4000 | — | — |
| Straight Flush (6 or 7 card) | — | — | — | — | — | 300 | 600 |
| Straight Flush | 50 | 100 | 150 | 200 | 250 | — | — |
| 5/6 of a Kind | — | — | — | — | — | 150 | 300 |
| Four of a Kind | 25 | 50 | 75 | 100 | 125 | — | — |
| Full House | 8 | 16 | 24 | 32 | 40 | — | — |
| 5/6 Card Flush | — | — | — | — | — | 30 | 60 |
| Flush | 5 | 10 | 15 | 20 | 25 | — | — |
| 5/6 Card Straight | — | — | — | — | — | 24 | 48 |
| Straight | 4 | 8 | 12 | 16 | 20 | — | — |
| Three of a Kind | 3 | 6 | 9 | 12 | 15 | — | — |
| Two Pairs | 2 | 4 | 6 | 8 | 10 | — | — |
| Pair of Jacks (or better) | 1 | 2 | 3 | 4 | 5 | — | — |

The operation of the game will now be explained by aid of a number of examples. Each of the Examples 1-7 corresponds to the EXTRA CARDS OPTIONAL version of the game of the present invention.

EXAMPLE 1

Player inserts five tokens and presses the "Deal" button. The machine deals the player the following cards:

| Card # | 1 | 2 | 3 | 4 | 5 | 6 | 7 |
|---|---|---|---|---|---|---|---|
| | A♥ | K♥ | Q♥ | J♥ | 10♥ | 9♥ | 8♥ |

In this situation, the player has a five card Royal Flush, a six card Royal Flush or a seven card Royal Flush. If the player does not elect to play the extra sixth or seventh card, the player would win the amount for a five card Royal Flush. If the player wagers an additional token to be eligible for the sixth card, the player would win the amount for a six card Royal Flush. If the player wagers two additional tokens to be eligible for the both the sixth and seventh cards, the player would win the amount for a seven card Royal Flush. No draw of new cards would be necessary because the player has been dealt the maximum hand. As is apparent, the player would simply wager the extra tokens necessary to play the seven-card hand and hold all seven cards to win the payout. This is also the hand that would win the progressive jackpot amount if that feature were in effect.

EXAMPLE 2

Player inserts five tokens and presses the "Deal" button. The machine deals the player the following cards:

| Card # | 1 | 2 | 3 | 4 | 5 | 6 | 7 |
|---|---|---|---|---|---|---|---|
| | A ♥ | K ♥ | Q ♥ | J ♥ | 9 ♥ | 8 ♥ | 10 ♥ |

In this situation, the player has a five card Flush, a six card Flush or a seven card Royal Flush. If the player does not elect to play the extra sixth or seventh card, the player would win the amount for a five card Flush. If the player wagers an additional token to be eligible for the sixth card, the player would win the amount for a six card Flush. If the player wagers two additional tokens to be eligible for both the sixth and seventh cards, the player would win the amount for a seven card Royal Flush. No draw I5 of new cards would be necessary because the player has been dealt the maximum seven card hand. As is apparent, the player would simply wager the extra tokens necessary to play the seven-card hand and hold all seven cards to win the payout. This is also the hand that would win the progressive jackpot amount if that feature were in effect. Although not likely, the player technically could only play the five card hand, discard the 9 ♥ and hope that he drew the 10 ♥ on the draw. Likewise although not likely, the player technically could play one additional token for the six card hand, cancel the 8 ♥ and hope that he drew the 10 ♥ on the draw.

EXAMPLE 3

Player inserts five tokens and presses the "Deal" button. The machine deals the player the following cards:

| Card # | 1 | 2 | 3 | 4 | 5 | 6 | 7 |
|---|---|---|---|---|---|---|---|
| | A ♠ | K ♠ | Q ♠ | J ♠ | 10 ♠ | 9 ♠ | 8 ♠ |

In this situation, the player has a five card Royal Flush, a six card Straight or a seven card Straight. If the player does not elect to play the extra sixth or seventh card, the player could hold the first five cards and win the amount for a five card Royal Flush. If the player wagers an additional token to be eligible for the sixth card, the player could hold the first six cards and the player would win the amount for the higher of the five card hand or the six card hand. In this example, the five card Royal Flush has a higher payout than a six card Straight. If the player wagers two additional tokens to be eligible for both the sixth and seventh cards, the player would win the amount for the higher of the five card hand, the six card hand or the a seven card hand. In this example, the five card Royal Flush has a higher payout than a six card Straight or a seven card Straight. In this example, if the player wanted to play the sixth or seventh card option, he would deposit the required additional token or tokens and then he could cancel those cards he did want to hold and obtain replacement cards. The replacement cards would or would not improve the player's six or seven card hands. Regardless of the improvement or not of the player's six or seven card hands, the player has not forfeited the opportunity to receive the payout for the five card Royal Flush by electing to participate in the six- or seven-card game.

EXAMPLE 4

Player inserts five tokens and presses the "Deal" button. The machine deals the player the following cards:

| Card # | 1 | 2 | 3 | 4 | 5 | 6 | 7 |
|---|---|---|---|---|---|---|---|
| | A ♥ | K ♥ | Q ♥ | J ♥ | 10 ♦ | 9 ♠ | 10 ♥ |

In this situation, the player has a five card Straight, a six card Straight or a seven card Pair of 10's. The five card Royal Flush that could possibly be made by combining the seventh card 10 with the first four cards is not a winning hand because, in this version of the game, the seventh card can only be used in the extra card section of the hand, and accordingly in the extra card section of the payout schedule. If the player did not elect to play the extra sixth or seventh card, the player could hold the first five cards and win the amount for a five card Straight. The player could also simply discard and draw to his five card hand in an attempt to improve his five card hand. If the player wagers an additional token to be eligible for the sixth card, the player could hold the first six cards and win the amount for the higher of the five card hand or the six card hand. In this example, the six card Straight would pay out more than the five card Straight. If the player wagers two additional tokens to be eligible for both the sixth and seventh cards, the player would win the amount for the higher of the five card hand, the six card hand or the seven card hand. In this example, the six card Straight would pay out more than the five card Straight and there is no payout for the seven card combination.

If the player wishes to draw new cards, he could cancel those cards he did want to hold and obtain replacement cards. It is possible that the replacement cards would or would not improve the player's six or seven card hands. Depending on the result of the draw, the player would win the amount for the higher of the five card hand, the six card hand or the seven card hand. For example, after the draw the player could have the following cards:

| Card # | 1 | 2 | 3 | 4 | 5 | 6 | 7 |
|---|---|---|---|---|---|---|---|
| | A ♥ | K ♥ | Q ♥ | J ♥ | 9 ♥ | 2 ♣ | 10 ♥ |

In this example, the highest hand held by the player is a six card Royal Flush and the player wins the amount on the payout schedule for a six card Royal Flush.

EXAMPLE 5

Player inserts five tokens and presses the "Deal" button. The machine deals the player the following cards:

| Card # | 1 | 2 | 3 | 4 | 5 | 6 | 7 |
|---|---|---|---|---|---|---|---|
| | A ♥ | A ♦ | A ♣ | A ♠ | 10 ♦ | 9 ♠ | 10 ♥ |

In this situation, the player has a five card Four-of-a-Kind, a six card nothing or a seven card pair of 10's. If the player did not elect to play the extra sixth or seventh card, the player could hold the first five cards and win the amount for a five card Four-of-a-Kind. If the player wagers an additional token to be eligible for the sixth card, the player could hold the first six cards and win the amount for the higher of the five card hand or the six card hand. In this example, the player would win the amount for a five card Four-of-a-Kind, because there is no payout for the particular six card hand that the player has. If the player wagers two additional tokens to be eligible for both the sixth and seventh cards, the player would win the amount for the higher of the five card hand, the six card hand or the seven card hand. In this example, the player would win the amount for a five card Four-of-a-Kind, because there is no payout for the particular six card hand or seven card hand that the player has.

In this example, if the player wanted to play the sixth or seventh card option, he would deposit the required additional token or tokens and then he could cancel those cards he did want to hold and obtain replacement cards. It is possible that the replacement cards would or would not improve the player's six or seven card hand. Depending on the result of the draw, the player would win the amount for the higher of the five card hand, the six card hand or the seven card hand. For example, after the draw the player could have the following cards:

| Card # | 1 | 2 | 3 | 4 | 5 | 6 | 7 |
|---|---|---|---|---|---|---|---|
| | A ♥ | A ♦ | A ♣ | A ♠ | 6 ♣ | 4 ♠ | A ♥ |

In this example, the highest hand held by the player is a Five-of-a-Kind and the player wins the amount on the payout schedule for a Five-of-a-Kind.

EXAMPLE 6

Player inserts five tokens and presses the "Deal" button. The machine deals the player the following cards:

| Card # | 1 | 2 | 3 | 4 | 5 | 6 | 7 |
|---|---|---|---|---|---|---|---|
| | A ♥ | A ♦ | A ♣ | 9 ♠ | 10 ♦ | A ♠ | A ♠ |

In this situation, the player has a five card Three-of-a-Kind, a six card Four-of-a-Kind which pays nothing or a seven card Five-of-a-Kind which also pays nothing. If the player did not elect to play the extra sixth or seventh card, the player could hold the first five cards and win the amount for a five card Three-of-a-Kind. The player could also simply discard and draw to his five card hand in an attempt to improve his five card hand. If the player wagers an additional token to be eligible for the sixth card, the player could hold the first six cards and win the amount for the higher of the five card hand or the six card hand. In this example, the player would win the amount for a five card Three-of-a-Kind, because there is no payout for the particular six card hand that the player has. If the player wagers two additional tokens to be eligible for both the sixth and seventh cards, the player would win the amount for the higher of the five card hand, the six card hand or the seven card hand. In this example, the player would win the amount for a five card Three-of-a-Kind, because there is no payout for the particular six card hand or seven card hand that the player has.

In this example, if the player wanted to play the sixth or seventh card option, he would deposit the required additional token or tokens and then he could cancel those cards he did not want to hold and obtain replacement cards. It is possible that the replacement cards would or would not improve the player's six or seven card hands. Depending on the result of the draw, the player would win the amount for the higher of the five card hand, the six card hand or the seven card hand. For example, after the draw the player could have the following cards:

| Card # | 1 | 2 | 3 | 4 | 5 | 6 | 7 |
|---|---|---|---|---|---|---|---|
| | A ♥ | A ♦ | A ♣ | A ♠ | 6 ♣ | A ♠ | A ♠ |

In this example, the highest hand held by the player is a Six-of-a-Kind and the player wins the amount on the payout schedule for a Six-of-a-Kind.

EXAMPLE 7

Player inserts five tokens and presses the "Deal" button. The machine deals the player the following cards:

| Card # | 1 | 2 | 3 | 4 | 5 | 6 | 7 |
|---|---|---|---|---|---|---|---|
| | A ♥ | A ♦ | A ♣ | A ♠ | 10 ♦ | 9 ♠ | 8 ♠ |

In this situation, the player has a five card Four-of-a-Kind, a six card Four-of-a-Kind which pays nothing or a seven card Four-of-a-Kind which also pays nothing. If the player did not elect to play the extra sixth or seventh card, the player could hold the first five cards and win the amount for a five card Four-of-a-Kind. The player could also simply discard the 10 and draw to his five card hand in an attempt to improve his five card hand although this is unlikely since there is no one card that can improve the player's five card hand into a higher payout amount. If the player wagers an additional token to be eligible for the sixth card, the player could hold the first six cards and win the amount for the higher of the five card hand or the six card hand. In this example, the player would win the amount for a five card Four-of-a-Kind, because there is no payout for the particular six card hand that the player has. If the player wagers two additional tokens to be eligible for both the sixth and seventh cards, the player would win the amount for the higher of the five card hand, the six card hand or the seven card hand. In this example, the player would win the amount for a five card Four-of-a-Kind, because there is no payout for the particular six card hand or seven card hand that the player has. In this example, if the player wanted to play the sixth or seventh card option, he would deposit the required additional token or tokens and then he could cancel those cards he did want to hold and obtain replacement cards. It is possible that the replacement cards would or would not improve the player's six or seven card hands. Depending on the result of the draw, the player would win the amount for the higher of the five card hand, the six card hand or the seven card hand. For example, after the draw the player could have the following cards:

| Card # | 1 | 2 | 3 | 4 | 5 | 6 | 7 |
|---|---|---|---|---|---|---|---|
| | A ♥ | A ♦ | A ♠ | A ♠ | 6 ♣ | 4 ♠ | A ♥ |

In this example, the highest hand held by the player is a Five-of-a-Kind and the player wins the amount on the payout schedule for a Five-of-a-Kind.

VERSION 2. EXTRA CARDS INTERCHANGEABLE. The game of this preferred embodiment of the present invention begins in the same way as conventional video poker begins. The player inserts a token or coin to activate the game. In the preferred embodiment of the present invention, if the player inserts five tokens or less, the player can only play the game of five-card draw and the player does not have the option of playing with either the sixth or the seventh extra card. The player must play at least six tokens to activate the sixth and seventh extra cards.

If the player has elected to play regular five-card draw poker (i.e., the player has wagers five or less tokens) the game proceeds as in conventional video poker. The extra cards displayed to the player are simply ignored and form no part of the regular five-card game. Following the draw step, if the player has a winning hand, he receives the appropriate payout shown in the schedule in FIG. 7 corresponding to the number of tokens or coins between one and five that the player wagers.

Assuming the player wishes to play the version of the game in which the sixth and seventh cards are activated, after the initial six tokens have been inserted into the coin slot to activate the machine, the player presses the "Deal/Draw" button and five cards from a first deck of standard playing cards are displayed to the player. Also, two additional cards (the sixth and seventh cards) from a second standard playing card deck are also displayed to the player. At this point, the player decides which of the seven cards he will hold and which he will discard. Any of the cards discarded from the original five card hand are replaced by cards from the original deck. If the player also decides to discard either or both of the extra cards (the sixth or seventh card), these cards are replaced with a card or cards from the second deck. If multiple additional decks are being used, the sixth card would be replaced by a card from the second deck and the seventh card would be replaced by a card from the third deck. After the draw, the player receives payouts based upon the type of poker hand that the player has according to the payout schedule shown in FIG. 7 corresponding to the "5th" coin column, the "6th" coin column or the "7th" coin column, whichever would be the highest payout. In this EXTRA CARDS INTERCHANGEABLE version of the game, the cards in the sixth and seventh position can be intermixed with the cards in the first five positions to make the best five-, six- or seven-card hand.

Because in the preferred embodiment the extra sixth and seventh cards come from a separate deck or from two separate decks, it is possible for the player to achieve combinations of cards that could not be obtained using a single deck of standard playing cards. For example, it is possible to achieve Five-of-a-Kind or Six-of-a-Kind. Also, because extra cards are involved, it is possible to obtain six or seven card Flushes and six or seven card Straights. Additionally, six or seven card Straight Flushes can be obtained. In fact, the best hand that can be made is a seven card Royal Flush which would the Ace-King-Queen-Jack-Ten-Nine-Eight of the same suit. (For example, A♥ K♥ Q♥ J♥ 10♥ 9♥ 8♥ in any order or sequence.) The odds of obtaining a seven card Royal Flush are quite high and allow for a gaming establishment to pay a Super Jackpot on that combination. For example, a jackpot amount of 50,000 tokens, 10,000,000 tokens or even more could be paid.

In another alternative embodiment of the present invention, the Super Jackpot for a seven card Royal Flush could be made part of a progressive jackpot. Instead of merely paying a fixed amount for a seven card Royal Flush, a progressive register is used to determine the size of the payoff. A percentage of each token wagers to obtain the sixth and/or seventh card is allocated to an incrementing register electronically associated with the video machine. Each hand that is played that does not result in a paid hand results in the progressive register incrementing to a higher amount using the wagers made by the player to activate the six- and/or seven-card game. Eventually some lucky player will make a seven card Royal Flush and will win the amount displayed on the progressive register.

While the particular payouts that can be used are not critical to playing the game, typical payout schedules that are contemplated to work well in a gaming establishment have been developed. In the EXTRA CARDS INTERCHANGEABLE version of the game of the present invention in which the sixth or seventh cards are activated at the option of the player before the initial deal by the player wagering an additional token or tokens, the following payout schedule is preferred:

EXTRA CARDS INTERCHANGEABLE VERSION

EXTRA CARDS INTERCHANGEABLE VERSION

| | Number of Tokens Wagered | | | | | | |
|---|---|---|---|---|---|---|---|
| Type of Hand | One | Two | Three | Four | Five | Six | Seven |
| Royal Flush | 25 | 50 | 75 | 100 | 125 | 7000 | Super Jackpot |
| Straight Flush | 9 | 18 | 27 | 36 | 56 | 360 | 720 |
| 4/5/6 of a Kind | 5 | 10 | 15 | 20 | 25 | 150 | 300 |
| Full House | 3 | 6 | 9 | 12 | 15 | — | 96 |
| Flush | 2 | 4 | 6 | 8 | 10 | 30 | 60 |
| Straight | 2 | 4 | 6 | 8 | 10 | 24 | 48 |
| Three of a Kind | 1 | 2 | 3 | 4 | 5 | — | — |

The operation of the game will now be explained by aid of a number of examples. Each of the Examples 8–11 corresponds to the EXTRA CARDS INTERCHANGEABLE version of the game of the present invention.

EXAMPLE 8

Player inserts six tokens and presses the "Deal" button. The machine deals the player the following cards:

| Card # | 1 | 2 | 3 | 4 | 5 | 6 | 7 |
|---|---|---|---|---|---|---|---|
| | A ♥ | K ♥ | Q ♥ | J ♥ | 9 ♥ | 8 ♥ | 10 ♥ |

In this situation, because the cards are interchangeable, the player has either a five card Royal Flush, a six card Royal Flush or a seven card Royal Flush. Since the player elected to play the extra sixth and seventh cards prior to the deal, the player would win the amount for the highest hand, in this example the seven card Royal Flush. No draw of new cards would be necessary because the player has been dealt the maximum hand. This is also the hand that would win the progressive jackpot amount if that feature were in effect.

EXAMPLE 9

Player inserts six tokens and presses the "Deal" button. The machine deals the player the following cards:

| Card # | 1 | 2 | 3 | 4 | 5 | 6 | 7 |
|---|---|---|---|---|---|---|---|
| | A ♥ | K ♥ | Q ♥ | J ♥ | 10 ♦ | 9 ♠ | 10 ♥ |

In this situation, because the cards are interchangeable, the player has a five card Royal Flush, a six card Straight or a seven card pair of 10's. Since the player elected to play the extra sixth and seventh cards prior to the deal, the player simply discards those cards he wishes to discard and draws new cards. If the player is successful in improving his hand, he will receive the payout for the highest hand. If the player is unsuccessful, he will still receive the payout for a five card Royal Flush.

EXAMPLE 10

Player inserts six tokens and presses the "Deal" button. The machine deals the player the following cards:

| Card # | 1 | 2 | 3 | 4 | 5 | 6 | 7 |
|---|---|---|---|---|---|---|---|
| | A ♥ | A ♦ | A ♣ | 9 ♠ | 10 ♦ | A ♠ | A ♠ |

In this situation, because the cards are interchangeable, the player has a five card Five-of-a-Kind, a six card Five-of-a-Kind or a seven card Five-of-a-Kind. Since the player elected to play the extra sixth and seventh cards prior to the deal, the player simply discards those cards he wishes to discard and draws new cards. As is apparent the player will discard the fourth and fifth position cards in an attempt to achieve a Six-of-a-Kind. If the player is successful, he will receive the highest payout. If the player is unsuccessful, he will still receive the payout for a six card Five-of-a-Kind, which is the highest payout for this combination of cards shown in the payout schedule in FIG. 7.

EXAMPLE 11

Player inserts six tokens and presses the "Deal" button. The machine deals the player the following cards:

| Card # | 1 | 2 | 3 | 4 | 5 | 6 | 7 |
|---|---|---|---|---|---|---|---|
| | A ♥ | A ♦ | A ♣ | A ♠ | 10 ♦ | 9 ♠ | 8 ♠ |

In this situation, the player has a five card Four-of-a-Kind, a six card Four-of-a-Kind or a seven card Four-of-a-Kind which both pay nothing. Since the player elected to play the extra sixth and seventh cards prior to the deal, the player simply discards those cards he wishes to discard and draws new cards. As is apparent the player will discard the sixth and seventh cards in an attempt to achieve a Five- or Six-of-a-Kind. If the player is successful, he will receive the highest payout. If the player is unsuccessful, he will still receive the payout for a five card Four-of-a-Kind, which is the highest payout for this combination of cards shown in the payout schedule in FIG. 7.

The actual numbers used for the payout schedule may vary. The payouts made to the player for the particular types of poker hands that the player achieves can be increased or decreased at the discretion of the gaming establishment. In an amusement version of the game, the payouts can be substantially increased over those that reasonably can be made by a gaming establishment. In general terms, the preferred embodiment of the payout schedule would conform to that shown in the following tables depending on which version of the game is being used.

EXTRA CARDS OPTIONAL VERSION

EXTRA CARDS OPTIONAL VERSION

| | Number of Tokens Wagered | | | | | | |
|---|---|---|---|---|---|---|---|
| Type of Hand | One | Two | Three | Four | Five | Six | Seven |
| Royal Flush (6 or 7 card) | — | — | — | — | — | A | Super Jack-pot |
| Royal Flush | B | 2B | 3B | 4B | 16B | — | — |
| Straight Flush (6 or 7 card) | — | — | — | — | — | C | 2C |
| Straight Flush | D | 2D | 3D | 4D | 5D | — | — |
| 5/6 of a Kind | — | — | — | — | — | E | 2E |
| Four of a Kind | F | 2F | 3F | 4F | 5F | — | — |
| Full House | G | 2G | 3G | 4G | 5G | — | — |
| 5/6 Card Flush | — | — | — | — | — | H | 2H |
| Flush | I | 2I | 3I | 4I | 5I | — | — |
| 5/6 Card Straight | — | — | — | — | — | J | 2J |
| Straight | K | 2K | 3K | 4K | 5K | — | — |
| Three of a Kind | L | 2L | 3L | 4L | 5L | — | — |
| Two Pairs | M | 2M | 3M | 4M | 5M | — | — |
| Pair of Jacks (or better) | N | 2N | 3N | 4N | 5N | — | — |

EXTRA CARDS INTERCHANGEABLE DEAL VERSION

EXTRA CARDS INTERCHANGEABLE DEAL VERSION

| | Number of Tokens Wagered | | | | | | |
|---|---|---|---|---|---|---|---|
| Type of Hand | One | Two | Three | Four | Five | Six | Seven |
| Royal Flush | Q | 2Q | 3Q | 4Q | 5Q | 280Q | Super Jack-pot |
| Straight Flush | R | 2R | 3R | 4R | 5R | 40R | 80R |
| 4/5/6 of a Kind | S | 2S | 3S | 4S | 5S | 30S | 60S |
| Full House | T | 2T | 3T | 4T | 5T | — | 32T |
| Flush | U | 2U | 3U | 4U | 5U | 15U | 30U |
| Straight | V | 2V | 3V | 4V | 5V | 12V | 24V |
| Three of a Kind | W | 2W | 3W | 4W | 5W | — | — |

The game of the present invention can also be modified by adding other extra cards and by using other additional decks to serve as the source for these other additional cards. It would be simply a matter of determining the appropriate winning combinations that could be made and adjusting the payout schedule to suitably reward the player for achieving the particular winning combinations.

In another variation of the game of the present invention, the player may elect to play a game in which the only means of winning is to achieve very high hands such as a royal flush. The odds and payouts are adjusted accordingly. Such a game may be referred to as "Power Poker" in that the payoff and odds are skewed to only pay off when a very low probability event, e.g., the royal flush or seven of a kind is achieved. Progressive jackpots and wagering according to the invention as described above may be part of this embodiment of the game. This version of the game has the benefit of appealing to the player who is only interested in extremely high payoffs on the order of those available from lotteries and the like.

The above embodiment of the game may also be incorporated in a further embodiment which allows the payoffs to be made on the basis of play among a plurality of individual video poker machines or the like. In such an embodiment, the payoff odds may be adjusted according to the number of machines being played by a single player. The player may log on or otherwise indicate his desire to play a plurality of machines with the basic game according to the above embodiments, but by choosing to play a plurality of games at once, the payoffs may be adjusted to favor a larger payoff for the higher hands at the expense of the payoffs for lower hands. Thus, the player can chose to wager on a larger number of machines and enhance his ability to win larger jackpots without restricting his gaming to a single machine with a given set of odds.

While the invention has been illustrated with respect to several specific embodiments thereof, these embodiments should be considered as illustrative rather than limiting. Various modifications and additions may be made and will be apparent to those skilled in the art. For example, many electronic gaming devices such as video poker machines now accrue credits when the player wins. If the player wishes to play another hand, the machine permits him to make additional wagers from his accrued credits by merely pushing a "Bet Credits" button on the display panel. It is within the scope of this invention to modify the gaming panel to provide for this "Bet Credit" feature. Both the initial wager by the player as well as any additional wagers necessary to activate the extra sixth or seventh cards can be controlled using a "Bet Credit" feature.

Other modifications can be made to the game of the present invention. Rather than using one or two extra cards, the game could be modified using any number of extra cards, such as three, four, five or even more. Very large payouts can be made on, for example, a ten card Royal Flush since the odds against achieving a ten card Royal Flush would be extremely high. As discussed above with regard to the two extra cards version of the game, each of the extra cards could come from a separate deck of cards, or alternatively, only one additional deck of cards could be the source of all the extra cards, or alternatively, some of the extra cards could come from one additional deck of cards and the other extra cards could come from a second or more additional decks of cards.

Still other modifications to the manner of play could be made. In the EXTRA CARDS OPTIONAL version of the game, the player could be required to deposit the extra token for the extra cards before the initial deal of the hand. One, some or all of the extra cards could be dealt face down initially and the face down cards would not be revealed to the player until he deposits the extra token or tokens necessary to activate these cards. According to the invention, it is also possible to have multiple progressive payouts for other hands, such as four of a kind, to thereby increase player appeal and thereby add additional incentive for wagering.

Winning card combinations, other than those shown in the payout schedules, can result in payouts to the player. For example, a seven card Full House (four cards of one denomination and three cards of another denomination—4 Aces and 3 Kings) could be a winning hand. Also, higher payouts could be awarded to a player who achieved a particular hand in order or in sequence.

Although specific embodiments have been described and illustrated, it is clear that it is susceptible to numerous modifications and embodiments within the ability of those skilled in the art and without the exercise of the inventive process.

Accordingly, the invention should not be limited by the foregoing description, but rather should be defined only by the appended claims.

I claim:

1. A method of playing a game of poker comprising the steps of:

a) a player initiating the game, b) dealing to the player five cards from a first deck of standard playing cards representing a player's hand, c) dealing to the player a sixth and seventh card from at least one additional deck of standard playing cards representing the player's extra cards, d) the player electing whether to play a five card, six card or seven card hand, 1) if the player elects to play a five card hand, the player selects those cards he wishes to hold and replacement cards are dealt to the player for those cards the player did not hold, the replacement cards for the first five cards coming from the first deck, 2) if the player elects to play a six card hand, the player selects those cards he wishes to hold and replacement cards are dealt to the player for those cards the player did not hold, the replacement cards for the first five cards coming from the first deck and the replacement card for the sixth card coming from at least one additional deck, 3) if the player elects to play a seven card hand, the player selects those cards he wishes to hold and replacement cards are dealt to the player for those cards the player did not hold, the replacement cards for the first five cards coming from the first deck and the replacement card or cards for the sixth and/or seventh card coming from the at least one additional deck, e) the player receiving a predetermined amount based on the type of poker hand that the player holds.

2. The method of claim 1 wherein the game is initiated by the player wagering one to five units of value.

3. The method of claim 2 wherein if the player elects to play six cards, the player wagers a second amount.

4. The method of claim 3 wherein the second amount is at least one unit of value.

5. The method of claim 3 wherein if the player elects to play seven cards, the player wagers a third amount.

6. The method of claim 5 wherein the third amount is at least one unit of value.

7. The method of claim 2 wherein the predetermined amount that a player receives is a progressive jackpot if the player holds a seven card Royal Flush.

8. The method of claim 2 wherein the predetermined amount that a player receives is according to the following schedule:

| Type of Hand | Number of Units of Value Wagered | | | | | | |
|---|---|---|---|---|---|---|---|
| | One | Two | Three | Four | Five | Six | Seven |
| Royal Flush (6 or 7 card) | — | — | — | — | — | 7000 | Super Jackpot |
| Royal Flush | 250 | 500 | 750 | 1000 | 4000 | — | — |
| Straight Flush (6 or 7 card) | — | — | — | — | — | 300 | 600 |
| Straight Flush | 50 | 100 | 150 | 200 | 250 | — | — |
| 5/6 of a Kind | — | — | — | — | — | 150 | 300 |
| Four of a Kind | 25 | 50 | 75 | 100 | 125 | — | — |
| Full House | 8 | 16 | 24 | 32 | 40 | — | — |
| 5/6 Card Flush | — | — | — | — | — | 30 | 60 |
| Flush | 5 | 10 | 15 | 20 | 25 | — | — |
| 5/6 Card Straight | — | — | — | — | — | 24 | 48 |
| Straight | 4 | 8 | 12 | 16 | 20 | — | — |
| Three of a Kind | 3 | 6 | 9 | 12 | 15 | — | — |
| Two Pairs | 2 | 4 | 6 | 8 | 10 | — | — |
| Pair of Jacks (or better) | 1 | 2 | 3 | 4 | 5 | — | — |

9. The method of claim 1 wherein the player elects to participate in a payoff relating only to a limited number of hands of those available, and the odds of such payoffs are different from those associated with the odds when a greater number of hands are payable.

10. The method of claim 9 wherein the amount payable for a winning hand is cumulative among a plurality of games being played.

11. The method of claim 9 wherein the election of participation in a limited number of hands requires the wagering of an additional amount prior to the dealing of the sixth and seventh cards.

12. A method of playing a game of poker comprising the steps of:

a) a player initiating the game, b) dealing to the player five cards from a first deck of standard playing cards representing the player's poker hand, c) dealing to the player at least one additional card from at least one additional deck of standard playing cards representing the player's extra cards, d) the player selecting those cards he wishes to hold, with replacement cards are dealt to the player for those cards the player did not hold, the replacement cards for the first five cards coming from the first deck, and the replacement card or cards for the sixth and/or seventh card coming from the at least one additional deck, e) the player receiving a predetermined amount based on the type of poker hand that the player holds.

13. The method of claim 12 wherein the initiation of the game further comprises wagering a preselected number of units of value.

14. The method of claim 13 wherein the preselected amount is at least six units of value.

15. The method of claim 13 wherein the predetermined amount that a player receives is a progressive jackpot if the player holds a seven card Royal Flush.

16. The method of claim 13 wherein the predetermined amount that a player receives is according to the following schedule:

| Type of Hand | Number of Tokens Wagered | | | | | | |
|---|---|---|---|---|---|---|---|
| | One | Two | Three | Four | Five | Six | Seven |
| Royal Flush | 25 | 50 | 75 | 100 | 125 | 7000 | Super Jackpot |
| Straight Flush | 9 | 18 | 27 | 36 | 45 | 360 | 720 |

-continued

| Type of Hand | Number of Tokens Wagered | | | | | | |
|---|---|---|---|---|---|---|---|
| | One | Two | Three | Four | Five | Six | Seven |
| 4/5/6 of a Kind | 5 | 10 | 15 | 20 | 25 | 150 | 300 |
| Full House | 3 | 6 | 9 | 12 | 15 | — | 96 |
| Flush | 2 | 4 | 6 | 8 | 10 | 30 | 60 |
| Straight | 2 | 4 | 6 | 8 | 10 | 24 | 48 |
| Three of a Kind | 1 | 2 | 3 | 4 | 5 | — | — |

17. The method of claim 13 wherein the player's hand can be a five card hand comprising any of the player's seven cards, a six card hand comprising any of the player's seven cards and a seven card hand. the player receiving the predetermined amount for whichever of the five card, six card or seven card hand has the highest payout.

18. A method of playing a game of poker comprising the steps of:

a) a player initiating the game, b) electronically displaying to the player five cards from a first deck of standard playing cards representing a player's hand, c) electronically displaying to the player a sixth and seventh card from at least one additional deck of standard playing cards representing the player's extra cards, d) the player electing whether to play a five card, six card or seven card hand, 1) if the player elects to play a five card hand, the player selects those cards he wishes to hold and replacement cards are electronically displayed to the player for those cards the player did not hold, the replacement cards for the first five cards coming from the first deck, 2) if the player elects to play a six card hand, the player selects those cards he wishes to hold and replacement cards are electronically displayed to the player for those cards the player did not hold, the replacement cards for the first five cards coming from the first deck and the replacement card for the sixth card coming from the at least one additional deck, 3) if the player elects to play a seven card hand, the player selects those cards he wishes to hold and replacement cards are electronically displayed to the player for those cards the player did not hold, the replacement cards for the first five cards coming from the first deck and the replacement card or cards for the sixth and/or seventh card coming from at least one additional deck, e) the player receiving a predetermined amount based on the type of poker hand that the player holds.

19. The method of claim 18 wherein the initiation of the game further comprises the wagering of a preselected number of units of value.

20. The method of claim 19 wherein the first amount is one to five units of value.

21. The method of claim 19 wherein if the player elects to play six cards, the player wagers a second amount.

22. The method of claim 21 wherein the second amount is at least one unit of value.

23. The method of claim 21 wherein if the player elects to play seven cards, the player wagers a third amount.

24. The method of claim 23 wherein the third amount is at least one unit of value.

25. The method of claim 19 wherein the predetermined amount that a player receives is a progressive jackpot if the player holds a seven card Royal Flush.

26. The method of claim 19 wherein the predetermined amount that a player receives is according to the following schedule:

| | Number of Units of Value Wagered | | | | | | |
|---|---|---|---|---|---|---|---|
| Type of Hand | One | Two | Three | Four | Five | Six | Seven |
| Royal Flush (6 or 7 card) | — | — | — | — | — | 7000 | Super Jackpot |
| Royal Flush | 250 | 500 | 750 | 1000 | 4000 | — | — |
| Straight Flush (6 or 7 card) | — | — | — | — | — | 300 | 600 |
| Straight Flush | 50 | 100 | 150 | 200 | 250 | — | — |
| 5/6 of a Kind | — | — | — | — | — | 150 | 300 |
| Four of a Kind | 25 | 50 | 75 | 100 | 125 | — | — |
| Full House | 8 | 16 | 24 | 32 | 40 | — | — |
| 5/6 Card Flush | — | — | — | — | — | 30 | 60 |
| Flush | 5 | 10 | 15 | 20 | 25 | — | — |
| 5/6 Card Straight | — | — | — | — | — | 24 | 48 |
| Straight | 4 | 8 | 12 | 16 | 20 | — | — |
| Three of a Kind | 3 | 6 | 9 | 12 | 15 | — | — |
| Two Pairs | 2 | 4 | 6 | 8 | 10 | — | — |
| Pair of Jacks (or better) | 1 | 2 | 3 | 4 | 5 | — | — |

27. A method of playing a game of poker comprising the steps of:

a) a player initiating the game, b) electronically displaying to the player five cards from a first deck of standard playing cards representing a player's hand, c) electronically displaying to the player a sixth and seventh card from at least one additional deck of standard playing cards representing the player's extra cards, d) the player selecting those cards he wishes to hold and replacement cards are electronically displayed to the player for those cards the player did not hold, the replacement cards for the first five cards coming from the first deck, and the replacement card or cards for the sixth and/or seventh card coming from the at least one additional deck, e) the player receiving a predetermined amount based on the type of poker hand that the player holds.

28. The method of claim 27 wherein the initiation of the game further comprises wagering a preselected number of units of value.

29. The method of claim 28 wherein the preselected amount is at least six units of value.

30. The method of claim 28 wherein the predetermined amount that a player receives is a progressive jackpot if the player holds a seven card Royal Flush.

31. The method of claim 28 wherein the predetermined amount that a player receives is according to the following schedule:

| | Number of Units of Value Wagered | | | | | | |
|---|---|---|---|---|---|---|---|
| Type of Hand | One | Two | Three | Four | Five | Six | Seven |
| Royal Flush | 25 | 50 | 75 | 100 | 125 | 7000 | Super Jack-pot |
| Straight Flush | 9 | 18 | 27 | 36 | 45 | 360 | 720 |
| 4/5/6 of a Kind | 5 | 10 | 15 | 20 | 25 | 150 | 300 |
| Full House | 3 | 6 | 9 | 12 | 15 | — | 96 |
| Flush | 2 | 4 | 6 | 8 | 10 | 30 | 60 |
| Straight | 2 | 4 | 6 | 8 | 10 | 24 | 48 |
| Three of a Kind | 1 | 2 | 3 | 4 | 5 | — | — |

32. The method of claim 28 wherein the player's hand can be a five card hand comprising any of the player's seven cards, a six card hand comprising any of the player's seven cards and a seven card hand, the player receiving the predetermined amount for whichever of the five card, six card or seven card hand has the highest payout.

* * * * *